US005433781A

United States Patent [19]

Bernert

[11] Patent Number: 5,433,781

[45] Date of Patent: Jul. 18, 1995

[54] SPREADING DEVICE FOR COATING MOVING WEBS OF MATERIAL

[75] Inventor: Richard Bernert, Giengen, Germany

[73] Assignee: J.M. Voith GmbH, Heidenheim, Germany

[21] Appl. No.: 213,118

[22] Filed: Mar. 14, 1994

[30] Foreign Application Priority Data

Mar. 20, 1993 [DE] Germany ..... 43 09 002.8

[51] Int. Cl.[6] ..... B05C 11/02

[52] U.S. Cl. ..... 118/118; 15/256.51; 15/256.52; 118/119; 118/123; 118/413; 118/414

[58] Field of Search ..... 118/70, 104, 110, 118, 118/119, 123, 203, 410, 413, 414; 162/281; 15/256.51, 256.52; 101/350, 363; 427/359, 361

[56] References Cited

U.S. PATENT DOCUMENTS

| | | | |
|---|---|---|---|
| 2,695,004 | 11/1954 | Montgomery et al. | 118/109 |
| 3,143,438 | 8/1964 | Campbell | 118/109 |
| 3,559,572 | 2/1971 | Hackley | 118/118 |
| 4,282,826 | 8/1981 | Wohlfeil | 118/118 |
| 4,658,753 | 4/1987 | Eklund | 118/118 |
| 4,773,351 | 9/1988 | Sollinger | 118/118 |
| 4,869,933 | 9/1989 | Sollinger et al. | 118/414 |
| 5,122,396 | 6/1992 | Bantanen | 15/256.52 |
| 5,238,511 | 7/1994 | Beisswanger | 15/256.51 |

FOREIGN PATENT DOCUMENTS

| | | | |
|---|---|---|---|
| 2106015 | 4/1983 | United Kingdom | 118/621 |

*Primary Examiner*—W. Gary Jones
*Assistant Examiner*—Laura E. Edwards
*Attorney, Agent, or Firm*—Marshall, O'Toole, Gerstein, Murray & Borun

[57] ABSTRACT

A spreading device for the coating of moving material webs, especially paper or cardboard includes a clamping mechanism adapted to alternatively hold a doctor rod support bed or a coating blade, a pressing tube for pressing a doctor rod mounted on the doctor rod support bed onto a counter roll or a material web guided by a counter roll, and a profile strip having a tip portion adapted to press against a coating blade, the profile strip movable in a direction transverse to the counter roll by a displacement device. A plane defined by a pressing force through a contact region of the pressing tube and the doctor rod support bed and a plane defined by a pressing force through a contact region of the profile strip and the coating blade are disposed transversely with respect to a length of the counter roll and are either parallel or disposed at an acute angle to one another.

16 Claims, 3 Drawing Sheets

Fig..1
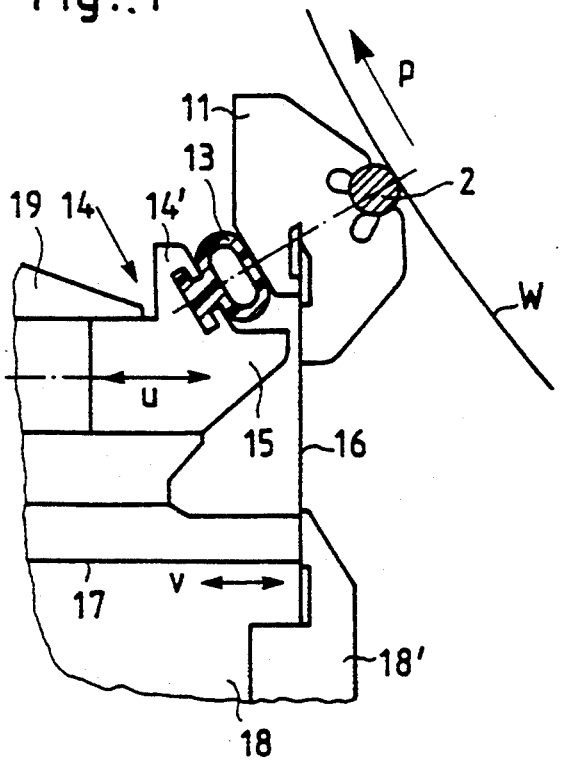
Fig. 2
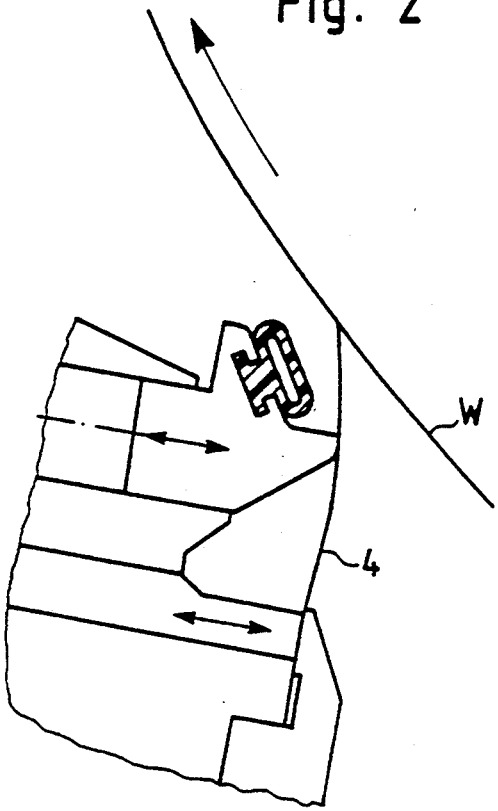
Fig. 3
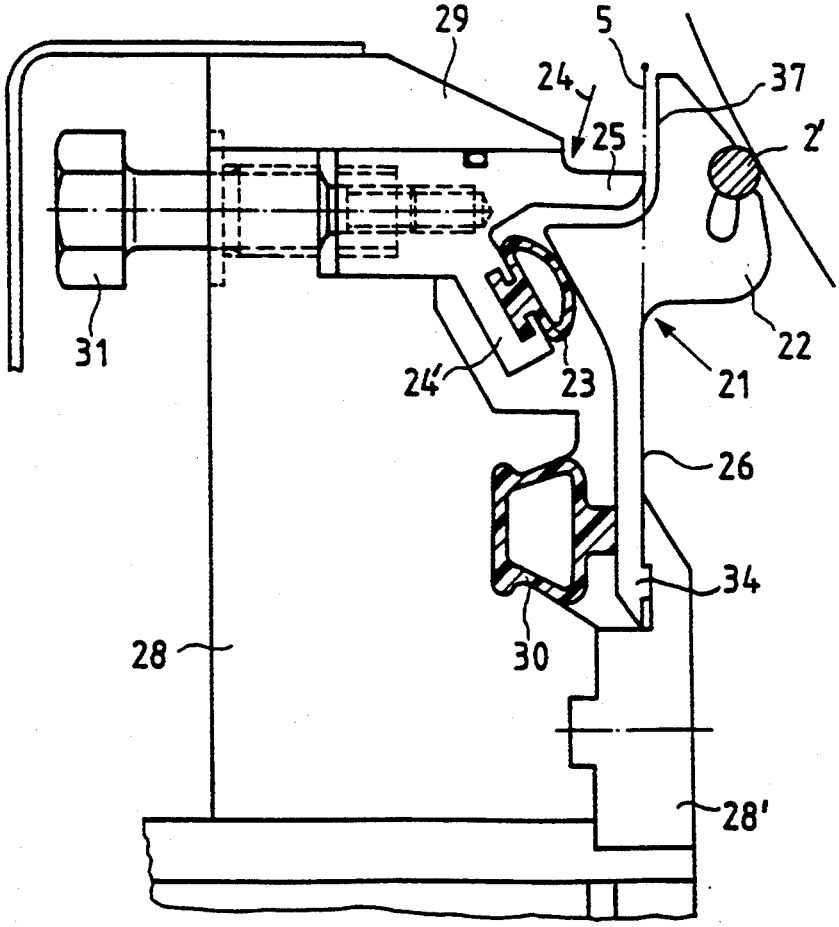

SPREADING DEVICE FOR COATING MOVING WEBS OF MATERIAL

BACKGROUND OF THE INVENTION

1. Field of the Invention

The invention relates to coating devices and in particular to an apparatus for holding a spreading device, such as a doctor blade or rod, utilized to regulate the coating thickness in the coating of a web of material.

2. Description of Related Technology

An apparatus for regulating the coating thickness in the coating of a web of material is disclosed in DE 28 51 014 (corresponding to Wohlfeil, U.S. Pat. No. 4,282,826 (Aug. 11, 1981)). Such a device includes a clamping mechanism for holding a flexible mounting member, a doctor rod support bed attached to the mounting member, and a doctor rod mounted in the doctor rod support. A thrust bar exerts pressure on a pressing tube which in turn presses against the doctor rod support, pressing the doctor rod onto a web of material wrapped onto a counter roll of a coating machine.

In the device disclosed in DE 28 51 014, the pressing tube is mounted on the doctor rod support bed. Thus, if the doctor rod and the doctor rod support bed are replaced with a coating blade, the thrust bar would become a profile strip (i.e. comb strip) and would press against the coating blade, retaining all the coating profiling possibilities. However, in the device disclosed in DE 28 51 014, it is necessary that the doctor rod bed support be supported in a sliding guide of the mounting member. Such a configuration typically requires the use of more expensive materials and is relatively expensive to manufacture. With respect to other spreading devices known in the art, the replacement of a doctor rod with a coating blade often requires extensive rebuilding of the device.

SUMMARY OF THE INVENTION

It is an object of the invention to overcome one or more of the problems described above. It is also an object of the invention to provide a spreading device in which the replacement of a doctor rod with a coating blade may be performed in a simple manner without any rebuilding of the device, especially when the device includes a profile strip for use with a coating blade and a pressing tube for use with a doctor rod.

According to the invention, a spreading device for the coating of moving material webs includes a clamping mechanism adapted to alternatively hold a doctor rod support bed or a coating blade, a pressing tube for pressing a doctor rod mounted on the doctor rod support bed onto a counter roll or a material web guided by a counter roll, and a profile strip having a tip portion adapted to press against a coating blade, the profile strip movable in a direction transverse to the counter roll by a displacement device. A plane defined by a pressing force through a contact region of the pressing tube and the doctor rod support bed and a plane defined by a pressing force through a contact region of the profile strip and the coating blade are disposed transversely with respect to a length of the counter roll and are either parallel or disposed at an acute angle to one another.

Other objects and advantages of the invention will be apparent to those skilled in the art from the following detailed description taken in conjunction with the drawings and the appended claims.

BRIEF DESCRIPTION OF THE DRAWINGS

FIG. 1 is a partially schematic sectional view of a device according to the invention including a doctor rod mounted in a doctor rod support bed.

FIG. 2 is a partially schematic sectional view of the device of FIG. 1 shown with a coating blade mounted thereon in lieu of the doctor rod and doctor rod support bed.

FIG. 3 is a partially schematic sectional view of a second embodiment of a device according to the invention.

DETAILED DESCRIPTION OF THE INVENTION

Figure 4:
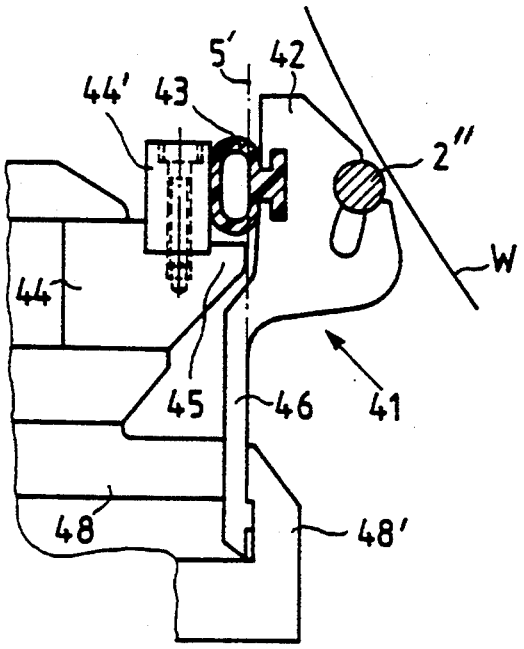
FIG. 4 is a partially schematic sectional view of a third embodiment of a device according to the invention.

A device according to the invention advantageously provides for the mounting of a pressing tube (adapted to press against a doctor rod support bed) onto a profile strip which includes a tip portion having a pressing surface at an end thereof adapted to press against a coating blade. A displaced force application line is thus obtained between the force of the profile strip acting via its tip portion on the coating blade, and the force of the pressing tube acting on the doctor blade support bed and the doctor rod. It is particularly preferred to have an angle between these two directions of force, whereby the line of force of the pressing tube extends preferably through a central axis of the doctor rod and is congruent to, or deviates only slightly from, the line of force defined by a radius of the counter roll which goes through the line of contact of the doctor rod and the counter roll.

It is also preferable to have the direction of force from the profile strip, including its tip portion, at an angle of between 55° and about 65° to the intersection of this line of force with a tangent of the roll surface. Then, preferably, the spreading device can be disposed in a lower quadrant of the counter roll.

With reference to FIG. 1, a web of material (not shown) onto which a coating material has been applied is guided about a counter roll W toward a doctor rod 2 which is mounted in a doctor rod support bed 11. The doctor rod 2 shown in FIG. 1 is a roll doctor rod. The doctor rod support bed 11 is mounted on a support plate 16 which is a leaf spring. The support plate 16 is secured to the device by a bar 17 and a clamping mechanism 18, 18'. The doctor rod support bed 11 is pressed by a pressing tube 13 toward the counter roll W. The pressing tube 13 is mounted on an extension portion 14' of a profile strip 14 having a tip portion 15. The profile strip 14 is slidingly mounted in a guide 19. The direction of movement of a web of material (not shown) or of the counter roll W is indicated by an arrow P. The directions of movement of the profile strip 14, including the tip portion 15, are indicated by a double arrow u, and the directions of movement of the bar 17 are indicated by a double arrow v.

It can be seen that the direction of force of the pressing tube 13 is inclined (i.e. at an angle) with respect to the direction of force of the profile strip 14, including its tip portion 15. The angle of inclination between the direction of force of the pressing tube and that of the profile strip ranges up to about 45°. The pressing tube force is directed here in such a way that it goes through a center axis of the doctor rod 2 and is congruent with, or deviates only slightly from, a radius of the counter roll W drawn from the contact line between the doctor rod 2 and the counter roll W. This pressing tube pressing force line is preferably disposed at an angle of between about 80° and about 90° with respect to a plane tangent to the doctor rod 2 and including a contact line between the doctor rod 2 and the counter roll W. When the support plate 16 is mounted in the clamping mechanism 18, 18' and is in an unbent, unstressed position, the support plate 16 preferably forms an angle of between about 25° and about 35° with the plane that is tangent to the doctor rod 2 and includes the contact line between the doctor rod 2 and the counter roll W.

FIG. 2 shows a spreading device according to the invention identical to the device shown in FIG. 1 with the exception that a coating blade 4 replaces the mounting plate 16, doctor rod support bed 11, and doctor rod 2 shown in FIG. 1. The inventive device does not require alteration or rebuilding to accommodate the coating blade 4. As shown in FIG. 2, the pressing tube 13 does not have any pressure applied to it. Rather, the tip portion 15 of the profile strip 14 includes a pressing edge which presses the coating blade 4 against the counter roll W. The pressing edge of the tip portion 15 is preferably spaced at least about 5 mm from the pressing tube 13 with respect to a direction toward the guide 19.

The spreading device according to the invention shown in FIGS. 1 and 2 is designed so that the device, including the clamping system 17 and 18' can swivel around an axis parallel a longitudinal axis of the counter roll W, to allow the coating blade edge to contact a material web drawn by the counter roll W. Adequate space is provided between a front edge of the tip portion 15 and the support plate 16, so that contact between the tip portion 15 and the support plate 16 is prevented, ensuring a satisfactory operation of the doctor rod 2.

An embodiment of a device according to the invention shown in FIG. 3 is similar to the device shown in FIG. 1, with elements identified by reference numerals 2', 22, 23, 24, 24', 25, and 26 corresponding functionally with elements identified by reference numerals 2, 11, 13, 14, 14', 15, and 16, respectively of FIG. 1. However, in contrast to FIG. 1, the tip portion 25 of the profile strip 24 is disposed at a larger distance from a clamping mechanism 28' and 34 than the pressing tube 23 (i.e. in the device shown in FIG. 1, the tip portion 15 is generally disposed between the clamping mechanism 18, 18' and the pressing tube 13, whereas, in the device shown in FIG. 3, the pressing tube 23 is generally disposed between the clamping mechanism 28' and the tip portion 25). The pressing tube 23 shown in FIG. 3 is held in the extension 24' of the profile strip 24.

Also with respect to FIG. 3, a doctor rod holder, generally 21, includes the doctor rod support bed 22 upon which the doctor rod 2' is mounted and the support plate 26 which is integral to the doctor rod support bed 22. The support plate 26 is displaced (i.e. offset) with respect to a back wall 37 of the doctor rod support bed 22 located in a region near the doctor rod 2, by at least a distance equal to a thickness of the support plate 26. Thus, the tip portion 25 of the profile strip 24 does not come in contact with the doctor rod support bed 22.

The angular orientation of the lines of force of the pressing tube 23, the profile strip 24, and the tip portion 25 of the device shown in FIG. 3 are the same as, or similar to, the angular orientation of the lines of force of the pressing tube 13, the profile strip 14 and the tip portion 15, respectively, shown in FIG. 1. The profile strip 24 is slidingly mounted in a sliding guide 29. Securing of the doctor rod support bed 22 to the device at the support plate 26 is provided by a clamp nose 34 and a pressing tube 30. A displacement device for moving the profile strip 24 is illustrated as a screw 31 and may be designed similarly to a device disclosed in U.S. Pat. No. 2,695,004.

An embodiment of a spreading device according to the invention shown in FIG. 4 shows a doctor rod holder 41 which is similar in design and function to the doctor rod holder 21 shown in FIG. 3. The doctor rod holder 41 cooperates with a clamping system 48, 48' which holds the support plate 46. However, in the embodiment shown in FIG. 4, a pressing tube 43 is mounted on a doctor rod support bed 41. A bar 44' attached to an extension part presses against the pressing tube 43.

When the doctor rod holder 41 and attached pressing tube 43 are removed from the device and replaced with a coating blade 5' (shown in phantom), a tip portion 45 of the extension part 44 presses against the blade 5'. As with the device shown in FIG. 3, the displacement of the holding plate 46 with respect to the doctor rod support bed 42 is chosen so that a front edge of the tip portion 45 does not touch the doctor rod support bed 42.

Figure 5:
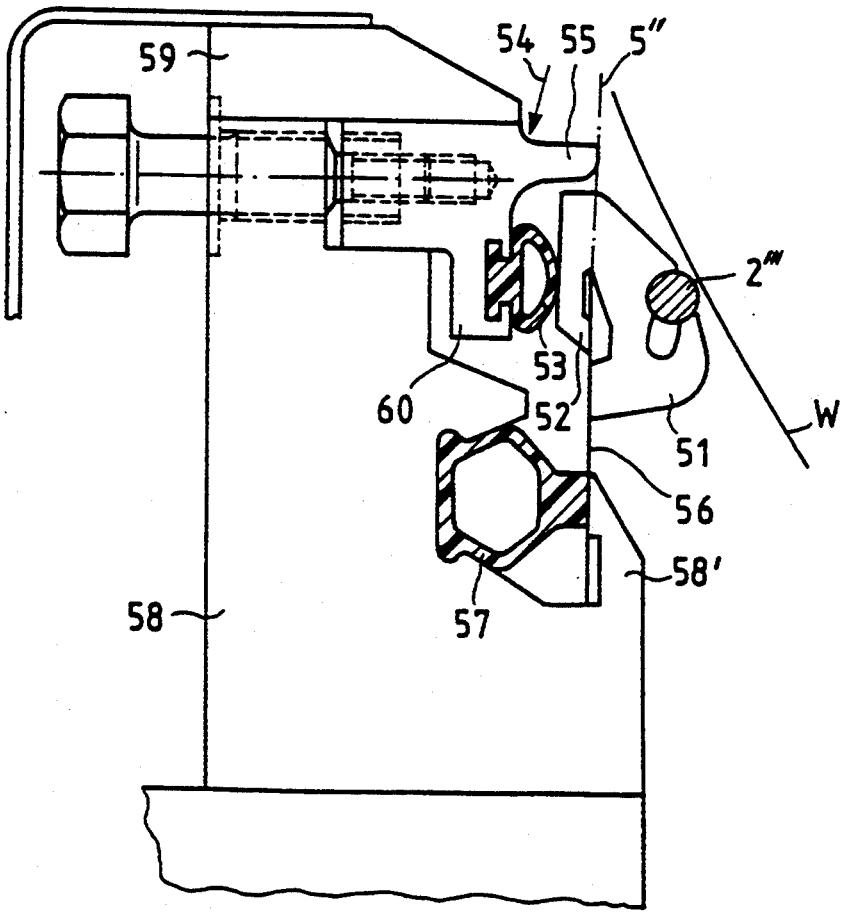
FIG. 5 is a partially schematic sectional view of a fourth embodiment of a device according to the invention.

An embodiment of a spreading device according to the invention shown in FIG. 5 is similar to the embodiments shown in FIGS. 1–4. In particular, the embodiment includes a doctor rod support bed 51 mounted on a support plate 56 in the form of a leaf spring similar in design and function to the doctor rod support bed 11 and support plate 16 shown in FIG. 1. A clamping mechanism 58, 58', and a pressing tube 57 hold the support plate 56. The leaf-spring-like support plate 56 also is clamped in an extension 52 of the doctor rod support bed 51. A doctor rod 2''' mounted in the support bed 51 is pressed against a web of material on a counter roll W by a pressing tube 53 which provides a pressing force against the support bed 51. The pressing tube 53 is mounted on an extension 60 of a profile strip 54. The profile strip 54 includes a tip portion 55.

When the doctor rod support bed 51 and the support plate 56 are replaced with a coating blade 5'' (shown in phantom), the tip portion 55 supports and guides the coating blade 5''. The profile strip 54 is slidingly mounted in a guide 59.

Since there is freedom in the design of the mounting of the doctor rod support bed, the mounting plate 56 shown in FIG. 5 is selected to be rather short, so that the tip portion 55 of the profile strip 54 is substantially farther removed from the clamping mechanism 58, 58' than the pressing tube 53 and the doctor rod support bed 51 (i.e., the doctor rod support bed 51 and the pressing tube 53 are disposed between the tip portion 55 and the clamping mechanism 58, 58'). As a result, when the doctor rod support bed 51 is replaced with the coating blade 5'', a preferred positioning of the profile strip tip portion 55 against the coating blade 5'' is obtained. The sliding displacement of the profile strip 54 is similar to that described herein with respect to the profile strip 24 shown in FIG. 3.

Figure 6:
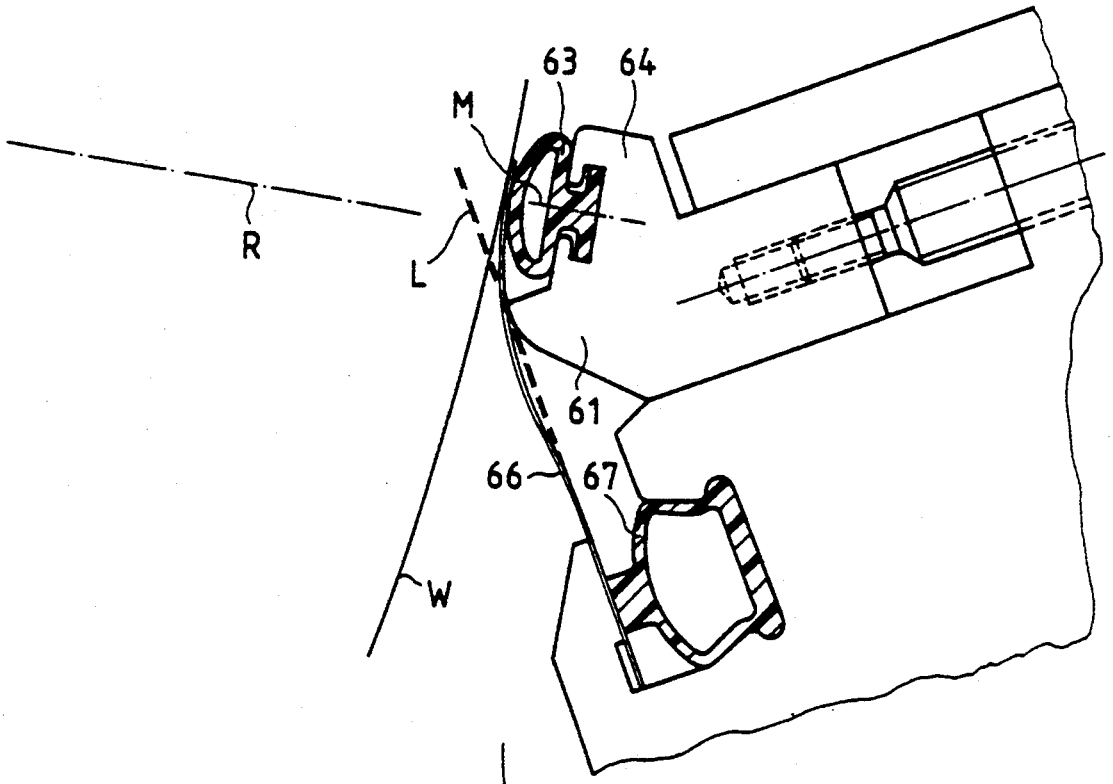
FIG. 6 is a partially schematic sectional view of a fifth embodiment of a device according to the invention.

While the embodiments described herein with respect to FIGS. 1–5 are designed for operation with a rigid coating blade, an embodiment of a spreading device according to the invention shown in FIG. 6 is designed for flexible, or bent-blade operation. As a result, the advantages resulting when a pressing tube is utilized are complemented by the advantages of the use of a profile strip. Namely, the profile strip has the advantage of better and more accurate control of a transverse spreading profile, while the pressing tube is relatively insensitive to defects in the material being coated (e.g. paper) and to irregular introduction of a printing ink.

However, the main advantage of an embodiment of the invention shown in FIG. 6 is that a pressing force can be applied in a more traditional manner by a relatively rigid profile strip 61 while, with the aid of the pressure provided by a pressing tube 63, a final pressing of a flexible blade 66 uniformly over the width of the web or the length of the roll can be achieved without being influenced by other limiting parameters. Overall, a relatively simple spreading device construction is obtained, which is not very expensive and is suitable for the rebuilding of older devices.

In the embodiment shown in FIG. 6, an extension 64 of the pressure or profile strip 61, upon the pressing tube 63 is mounted, is disposed in a region which is substantially removed from a clamping mechanism which holds the coating blade 66. A center plane M of the pressing force of the pressing tube 63 can be congruent with a radial plane R of counter roll W, parallel thereto, or form an angle of up to about 3° therewith. If the center plane M and the radial plane R are parallel, the space therebetween is at most about 8 mm. Preferably, there is an angle of about 45° to about 55° between the center plane M of the pressing force of the pressing tube 63 and a clamping plane L of the coating blade 66.

The distribution of the pressing forces between the profile strip 61 and the pressing tube 63 are preferably in a ratio of approximately two to one (2:1) (i.e. the pressing tube 63 applies between about 25% to about 35% of the total pressing force sustained by the flexible blade 66) in order to have a sufficiently large control region for the pressing pressure of the pressing tube 63. However, a device according to the invention may deviate from this ratio considerably.

Figure 7:
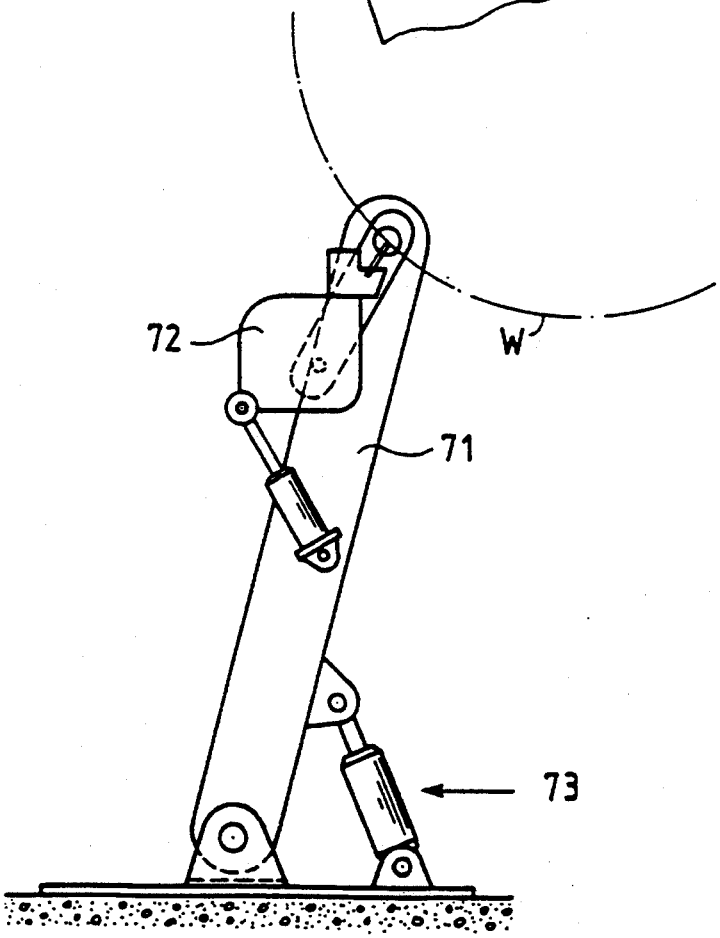
FIG. 7 is a schematic view of a device according to the invention shown installed on carrier arms of a coating device.

With reference to FIG. 7, the swiveling of a spreading device according to the invention preferably is achieved with carrier arms 71 of a doctor beam 72, upon which the spreading device is mounted. The swiveling radius of the carrier arms 71 is at least 500 mm, utilizing hydraulic lifting gear 73.

By the embodiments of the invention, both a coating blade and a doctor rod may be operated in a single device in a simple manner, without the need for expensive rebuilding of the device. With respect to the use of such a device with a doctor rod mounted in a doctor rod support bed, the distance between a surface of the holding element 16, 26, 46, or 56 facing a material web or a counter roll and a plane parallel to the holding element tangent to the doctor rod in a region close to and facing the counter roll, is generally 45 mm.

The foregoing detailed description is given for clearness of understanding only, and no unnecessary limitations should be understood therefrom, as modifications within the scope of the invention will be apparent to those skilled in the art.

I claim:

1. A device for applying a coating composition to a moving web of material comprising a spreading device and a counter roll disposed adjacent thereto, said spreading device further comprising:

(a) a doctor apparatus wherein said apparatus is one of a doctor rod mounted on a doctor rod support bed and a coating blade;

(b) means for holding said doctor apparatus mounted on the spreading device;

(c) a pressing tube mounted on the spreading device and contacting said doctor apparatus when said apparatus is a doctor rod mounted on a doctor rod support bed, said tube for pressing said doctor rod onto at least one of the counter roll and a material web guided by the counter roll;

(d) a profile strip mounted on the spreading device, said strip having a tip portion contacting said doctor apparatus when said apparatus is a coating blade, the profile strip for pressing against the coating blade and movable in a direction transverse to the counter roll by a displacement device; wherein (e) said pressing tube is oriented in relation to said profile strip such that a first reference plane is defined by a pressing force through a contact region of the pressing tube and the doctor apparatus when said apparatus is a doctor rod mounted on a doctor rod support bed and a second reference plane is defined by a pressing force through a contact region of the profile strip and the doctor apparatus when said apparatus is a coating blade, said first and second reference planes being disposed transversely with respect to a length of the counter roll and said first and second planes being one of (1) parallel to one another and (2) disposed at an acute angle of up to about 45° to one another.

2. The device of claim 1 wherein the pressing tube is mounted on the profile strip and wherein the profile strip is mounted in a guide disposed opposite the counter roll, said profile strip having a pressing edge for pressing against the doctor apparatus when said apparatus is a coating blade, said edge spaced at least about 5 mm from the pressing tube with respect to a direction toward the guide.

3. The device of claim 1 wherein said doctor apparatus is a doctor rod mounted on a doctor rod support bed and further comprising a holding plate integral with the doctor rod support bed, said holding plate offset from a back side of the support bed by at least a wall thickness thereof, said back side facing away from the counter roll and disposed in a region substantially in the vicinity of the doctor rod, whereby impact of the tip portion of the profile strip and the doctor rod support bed is prevented.

4. The device of claim 1 wherein said doctor apparatus is a doctor rod mounted on a doctor rod support bed and a line defined by a pressing force of the pressing tube is inclined with respect to a pressing force line of the profile strip and the tip portion, said pressing tube is oriented in relation to the doctor rod and the counter roll such that said pressing force line of the pressing tube extends through a center line of the doctor rod and is disposed at an angle of between about 80° and about 95° to a plane tangent to the doctor rod, said plane including a contact line between the doctor rod and the counter roll.

5. The device of claim 1 wherein said doctor apparatus is a doctor rod mounted on a doctor rod support bed, the doctor rod support bed mounted on a leaf spring attached to a holding mechanism and the pressing tube mounted on a holding extension of the profile strip, the holding extension disposed a further distance away from the holding mechanism than the distance from the tip portion of the profile strip to the holding mechanism.

6. The device of claim 1 wherein said doctor apparatus is a doctor rod mounted on a doctor rod support bed, the doctor rod support bed integral to a support plate attached to a holding mechanism and the pressing tube mounted on a holding extension of the profile strip, the holding extension disposed a lesser distance away from the holding mechanism than the distance from the tip portion of the profile strip to the holding mechanism.

7. The device of claim 1 wherein said doctor apparatus is a doctor rod mounted on a doctor rod support bed and the pressing tube is mounted on the doctor rod support bed.

8. The device of claim 1 wherein said doctor apparatus is a doctor rod mounted on a doctor rod support bed and the holding means comprises a mounting mechanism clamped to a mounting plate, said mounting plate attached to the doctor rod support bed, the mounting plate, when unstressed and unbent, forms an angle of between about 25° and about 35° with a plane tangent to the doctor rod, said plane including a contact line between the doctor rod and the counter roll.

9. The device of claim 1 wherein said spreading device is disposed in a lower quadrant of the counter roll.

10. The device of claim 1 wherein the device swivels around an axis parallel to the counter roll.

11. The device of claim 9 wherein said spreading device has a swiveling radius of at least about 500 mm.

12. The device of claim 1 wherein said doctor apparatus is a rigid coating blade and pressing pressure is placed on the coating blade by the profile strip.

13. The device of claim 1 wherein said doctor apparatus is a flexible coating blade and a substantial pressing pressure is exerted on the flexible blade by the pressing tube, said tube disposed in a holding extension of the profile strip spaced from the holding means.

14. The device of claim 13 wherein said pressing tube is oriented such that a line of force from the pressing tube onto the flexible blade is disposed in substantially the same plane as a radius of the counter roll, deviating at most about 3° from said radius.

15. The device of claim 13 wherein said pressing tube is oriented such that a plane comprising a line of force from the pressing tube onto the flexible blade is parallel to a plane comprising a radius of the counter roll, the distance between the two planes being 8 mm at most.

16. The device of claim 13 wherein the pressing tube applies between about 25% and about 35% of the total pressing force sustained by the flexible blade in order to control the pressing force thereof on at least one of the counter roll and a material web guided by the counter roll.

* * * * *